US011610598B2

(12) United States Patent
Hamilton et al.

(10) Patent No.: US 11,610,598 B2
(45) Date of Patent: Mar. 21, 2023

(54) VOICE ENHANCEMENT IN PRESENCE OF NOISE

(71) Applicant: Harris Global Communications, Inc., Rochester, NY (US)

(72) Inventors: James Hamilton, Rochester, NY (US); Keith Kripp, Pittsford, NY (US)

(73) Assignee: HARRIS GLOBAL COMMUNICATIONS, INC., Rochester, NY (US)

( * ) Notice: Subject to any disclaimer, the term of this patent is extended or adjusted under 35 U.S.C. 154(b) by 9 days.

(21) Appl. No.: 17/230,718

(22) Filed: Apr. 14, 2021

(65) Prior Publication Data

US 2022/0343933 A1 Oct. 27, 2022

(51) Int. Cl.

| | |
|---|---|
| ***G10L 21/0264*** | (2013.01) |
| ***G10L 25/06*** | (2013.01) |
| ***G10L 21/0232*** | (2013.01) |
| *G10L 21/0216* | (2013.01) |

(52) U.S. Cl.

CPC ..... *G10L 21/0264* (2013.01); *G10L 21/0232* (2013.01); *G10L 25/06* (2013.01); *G10L 2021/02165* (2013.01)

(58) Field of Classification Search

CPC . G10L 21/0232; G10L 21/0264; G10L 25/06; G10L 2021/02165

USPC ..... 704/226

See application file for complete search history.

(56) References Cited

U.S. PATENT DOCUMENTS 6,408,269 B1 * 6/2002 Wu ..... G10L 21/0208 704/228
8,131,541 B2 3/2012 Yen et al.
8,229,126 B2 7/2012 Chamberlain et al.
8,311,816 B2 * 11/2012 Toguri ..... H04B 14/068 704/226
9,438,992 B2 9/2016 Every et al.
2006/0140417 A1 6/2006 Zurek
2012/0057722 A1 * 3/2012 Osako ..... G10L 21/0208 381/94.2
2017/0032806 A1 * 2/2017 Konjeti ..... G10K 11/17854
2017/0365270 A1 * 12/2017 Yuan ..... G10L 21/0232

OTHER PUBLICATIONS

Deren Han, A generalized proximal-point-based prediction-correction method for variational inequality problems, Journal of Computational and Applied Mathematics, vol. 221, Issue 1, 2008, pp. 183-193, ISSN 0377-0427, (https://doi.org/10.1016/j.cam.2007.10.063.) (Year: 2008).*

* cited by examiner

*Primary Examiner* — Richemond Dorvil
*Assistant Examiner* — Rodrigo A Chavez
(74) *Attorney, Agent, or Firm* — Fox Rothscilds LLP; Robert J. Sacco; Carol Thorstad-Forsyth

(57) ABSTRACT

Communication terminal includes a first microphone system, a second microphone system, and a noise reduction processing unit (NRPU). The NRPU receives a primary signal from the first microphone system and a secondary signal from the second microphone system. The NRPU dynamically identify an optimal transfer function of a correction filter which can be applied to the secondary signal provided by the second microphone system to obtain a correction signal. The correction signal is subtracted from the primary signal to obtain a remainder signal which approximates a signal of interest contained within the primary signal.

23 Claims, 4 Drawing Sheets

VOICE ENHANCEMENT IN PRESENCE OF NOISE

BACKGROUND

Statement of the Technical Field

The technical field of this disclosure concerns communication systems and more particularly systems for reducing background noise from a signal of interest.

DESCRIPTION OF THE RELATED ART

The related art concerns methods and systems for reducing background noise in voice communications. Communication terminals used for public safety and professional communications (PSPC) are often required to operate in noisy environments. In the case of firefighters such background noise can include chainsaws, pumps, fans and so on. For police, the common background noise can arise from vehicular traffic, sirens, and crowds. Other users may need to operate their communication terminals in the presence of industrial machinery. Regardless of the exact source of such background noise, it is well-known that excessive noise can make difficult or completely inhibit radio communication. To the extent that communication is possible at all, even moderate amounts of background noise can be problematic insofar as is places cognitive strain on recipients, thereby increasing listener fatigue. Noise suppression is common in PSPC communications equipment, but a satisfactory solution to the problem has proven to be challenging.

Some systems for reducing background noise use multiple microphones and incorporate beamforming technology which seeks to amplify sounds in a direction of a user voice while reducing sounds from other directions. Other systems rely on the concept of near-field and far-filed acoustic attenuation to distinguish voice from noise. Such systems rely on a spectral subtraction technique to separate voice and noise. While these systems can be effective, they are costly to implement due the fact that they are highly sensitive to small differences in the response of the microphones that are used. Accordingly, the microphones must be calibrated at the factory and/or a separate algorithm must be implemented to dynamically equalize the microphones.

SUMMARY

This document concerns a method for noise reduction and a communication terminal that incorporates a noise reduction system. The method involves receiving a primary signal at a first microphone system of a communication device and a secondary signal at a second microphone system of the communication device. The first and the second microphone systems are disposed at first and second locations on the communication device which are separated by a distance. The method involves the use of a processing element to dynamically identify an optimal transfer function of a correction filter which can be applied to the secondary signal processed by the second microphone system to obtain a correction signal. Once the correction signal has been obtained, it is subtracted from the primary signal to obtain a remainder signal which approximates a signal of interest contained within the primary signal. According to one aspect, the optimal transfer function is dynamically determined by a series of operations. A sequence of estimates is generated which comprises both an autocorrelation of the secondary signal, and a cross-correlation of the secondary signal to primary signal. Thereafter, a noise filter is applied to each estimate in the sequence of estimates to obtain a sequence of filtered estimates with reduced noise. The optimal transfer function is then iteratively estimated using the sequence of filtered estimates.

According to one aspect, the filter is a Kalman filter. A computation cost of the Kalman filter process is reduced by defining both the vector representations of the correlation function and the autocorrelation function as atomic state variables. A computation cost of the Kalman filter is reduced by defining in the Kalman filter a variance associated with both an error around a current state estimate and a process noise to be scalar values. The Kalman gain is a scalar value and the optimal correction filter is determined using a Khobotov-Marcotte algorithm.

In the method described herein, it is understood that far field sound originating in a far field environment relative to the first and second microphone systems produces a first difference in sound signal amplitude at the first and second microphone systems. The sound signal amplitude of the far field sound is received at approximately equal amplitude levels in the first and second microphone systems. To achieve the foregoing, the location of first and second microphones respectively associated with the first and second microphone systems are carefully selected. The microphone locations also ensure that near field sound originating in a near field environment relative to the first microphone produces a second difference in sound signal amplitude at the first and second microphone systems. Notably, the second difference can be substantially greater than the first difference. The near field sound is received at a substantially higher sound signal amplitude by the first microphone system as compared to the second microphone system.

The solution also concerns a communication terminal. The communication terminal includes a first microphone system and a second microphone system. A noise reduction processing unit (NRPU) is also included in the communication terminal. The NRPU is configured to receive a primary signal from the first microphone system and a secondary signal from the second microphone system. Using a methodology described herein, the NRPU dynamically identifies an optimal transfer function of a correction filter which can be applied to the secondary signal provided by the second microphone system to obtain a correction signal. The NRPU causes the correction signal to be subtracted from the primary signal to obtain a remainder signal which approximates a signal of interest contained within the primary signal. The optimal optimal transfer function is dynamically determined by generating a sequence of estimates comprising both an autocorrelation of the secondary signal, and a cross-correlation of the secondary signal to primary signal. A noise filter is applied to each estimate in the sequence of estimates to obtain a sequence of filtered estimates with reduced noise and the optimal transfer function is iteratively estimated by the NRPU using the sequence of filtered estimates.

In the communication terminal described herein, the noise filter is advantageously selected to be a Kalman filter. Further, the NRPU can be configured to reduce a computation cost of the Kalman filter process by defining both the vector representations of the correlation function and the autocorrelation function as atomic state variables. According to one aspect, the NRPU is configured to reduce a computation cost of the Kalman filter by defining in the Kalman filter a variance associated with both an error around a current state estimate and a process noise to be scalar values. The Kalman gain is a scalar value and the NRPU is configured to determine the optimal correction filter by using a Khobotov-Marcotte algorithm.

In the communication terminal, the first microphone system includes a first microphone and the second microphone system includes a second microphone. The first and second microphones are respectively disposed at first and second locations on the communication terminal and separated by a predetermined distance. Consequently, a far field sound originating in a far field environment relative to the first and second microphones produces a first difference in sound signal amplitude at the first and second microphone systems. In particular, the first and second microphones are positioned so that the sound signal amplitude of the far field sound is received at approximately equal amplitude levels in the first and second microphone systems. The first and second microphones are also positioned to cause near field sound originating in a near field environment relative to the first microphone to produce a second difference in sound signal amplitude at the first and second microphone systems. The second difference is substantially greater than the first difference such that the near field sound is received at a substantially higher sound signal amplitude by the first microphone as compared to the second microphone.

BRIEF DESCRIPTION OF THE DRAWINGS

This disclosure is facilitated by reference to the following drawing figures, in which like reference numerals represent like parts and assemblies throughout the several views. The drawings are not to scale and are intended for use in conjunction with the explanations in the following detailed description.

DETAILED DESCRIPTION

Figure 1A:
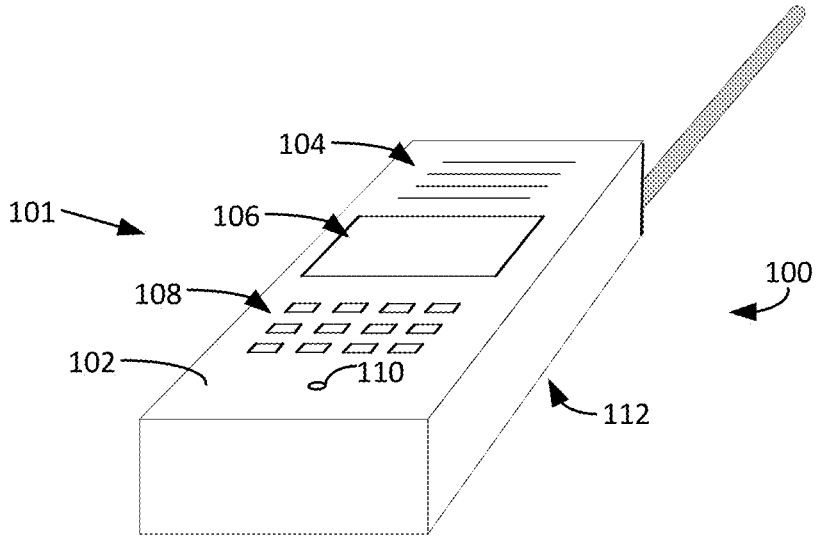
FIGS. 1A and 1B are a set of drawings that are useful for understanding certain feature of a communication terminal.

It will be readily understood that the solution described herein and illustrated in the appended figures could involve a wide variety of different configurations. Thus, the following more detailed description, as represented in the figures, is not intended to limit the scope of the present disclosure, but is merely representative of certain implementations in various different scenarios. Further, particular features described herein can be used in combination with other described features in each of the various possible combinations and permutations. It is noted that various features are described in detail with reference to the drawings, in which like reference numerals represent like parts and assemblies throughout the several views. While the various aspects are presented in the drawings, the drawings are not necessarily drawn to scale unless specifically indicated.

The methods and/or systems disclosed herein may provide certain advantages in a communication system. Specifically, the method and/or system will facilitate voice communications in the presence of environmental background noise.

Figure 1B:
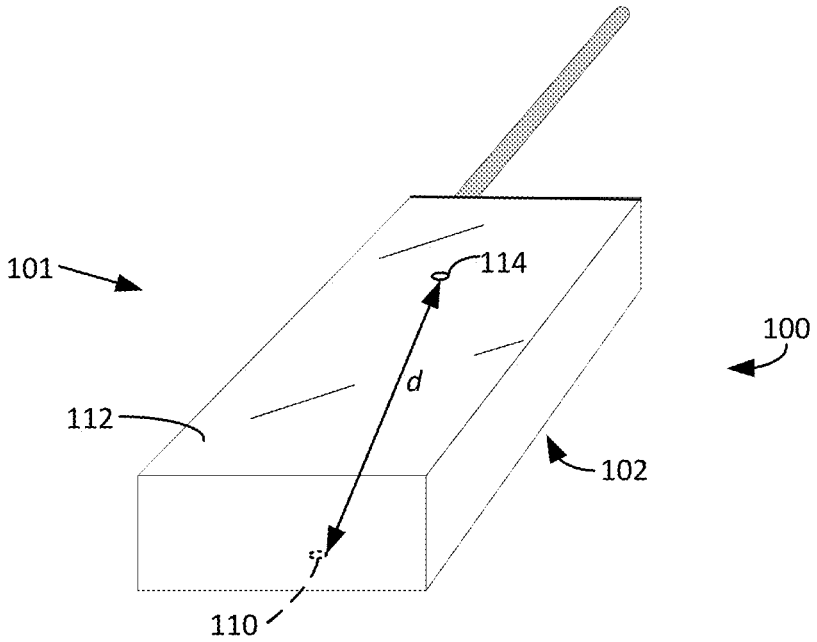

Shown in FIGS. 1A and 1B are drawings that are useful for understanding an arrangement of a communication terminal 100 in which a solution for reducing noise can be implemented. The communication terminal is comprised of a housing 101. In this example, there is disposed on a first side 102 of the housing a loudspeaker 104, a display 106, and a user interface 108. A first microphone 110 is also provided. In this example, the first microphone is disposed on the first side 102 of the housing. However, the solution is not limited in this regard and a second microphone can alternatively be disposed at a different location in or on the housing. A second microphone 114 is provided some distance d from the first microphone 110. For example, in some scenarios, the second microphone 114 can be disposed on a second side 112 of the housing.

With the foregoing microphone arrangement, there will usually be some difference in amplitude of audio signals that are received by the first microphone and the second microphone. This difference is dependent on the location of the sound source relative to the microphones due to the difference in a near field sound attenuation model and a far field sound attenuation model. Sound originating in a far field relative to the communications terminal 100 will be received by the first and second microphone at approximately equal sound amplitude levels. In contrast, sound originating in the near field relative to the first microphone 110 will be received by the second microphone at a much lower sound amplitude level. This phenomena can be exploited to remove noise sources located in the far field relative to the communication terminal.

Figure 2:
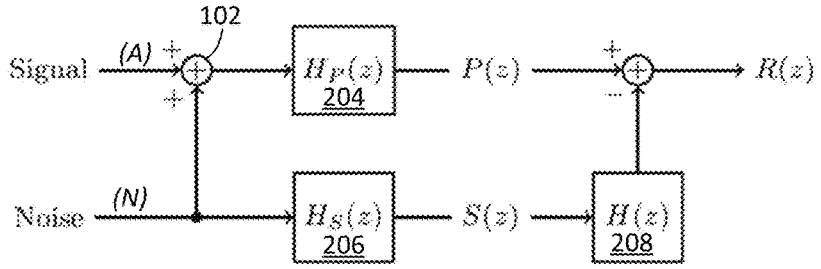
FIG. 2 is a flow diagram that is useful for understanding how noise originating in a far field relative to a communication terminal can be canceled or reduced.

Shown in FIG. 1 is a flow diagram that is useful for understanding a method for reducing noise in a communication terminal. In FIG. 1, a signal (A) represents a signal of interest (SOI) such as a user's voice. Environmental background noise is represented in FIG. 2 by signal (N). The communication terminal in this example includes a primary microphone system 204 and a secondary microphone system 206. The method described herein can include the use of additional secondary microphones, but for purposes of this example, only a single second microphone is included.

As noted above, the method described herein exploits a phenomena which involves a difference in the way that sound attenuates over distance relative to its source. The volume of sound that originates from a source in a near-field relative to a microphone location will attenuate rapidly as a function of distance. This is sometimes referred to as a near-field attenuation model. In contrast, the volume of sound that originates from a source in a far-field relative to a microphone location will attenuate much more slowly as a function of distance. This is sometimes referred to as a far-field attenuation model. In this solution, the user or speaker who is the source of signal (A) is understood to be in the near field relative to both the primary and secondary microphone systems 204, 206 whereas sources of noise are understood to be in the far field. Accordingly, attenuation of the voice signal (A) originating with the user will occur in accordance with a near-field attenuation model and the attenuation of noise signal (N) will occur in accordance with a far field attenuation model.

In the present solution it is understood that the primary microphone system 204 is positioned somewhat closer to the source of voice signal (A) as compared to secondary microphone 206. Consequently, as a result of the operation of the near field attenuation model, the voice signal will predominantly couple to only the primary microphone 204 whereas the noise signal (N) couples into both the primary 204 and the secondary microphone 206 approximately equally. As shown in FIG. 2, the primary microphone system 204 has a transfer function which is represented as $H_P(z)$ and the secondary microphone system 206 has a transfer function which is represented as $H_S(z)$. It is understood that the first and second microphone transfer functions may be different.

In FIG. 2, the signal (A) is corrupted by background noise (N). This is illustrated at 202 in FIG. 1 by the addition of the noise signal (N) to the signal (A). The resulting combined signal (A)+(N) is acted upon by a microphone transfer function $H_P(z)$ associated with the primary microphone 204. The resulting signal is $P(z)$. The noise signal (N) is acted upon by microphone transfer function $H_S(z)$ associated with the secondary microphone. The resulting signal is $S(z)$. The goal is to then subtract the noise from the signal of interest such that all that is left over is the remainder $R(z)$. The present solution involves applying the correct filter 208 having a transfer function $H(z)$ which will essentially subtract the noise signal that was input to the primary microphone 204. The filter is configured so that it attempts to account for several factors including the transfer functions $H_P(z)$ and $H_S(z)$ of the primary and secondary microphones, and the acoustics of the environment (flight time, acoustic delay, attenuation, and so on). In a scenario involving the use of a communication terminal 100 it will be understood that the acoustics of the environment can vary over time as the orientation and position of the device is moved with respect to the source of the signal of interest (e.g., a user voice) and a noise source. Accordingly, the filter 208 must be capable of adapting over time to different conditions. The characteristics of both $H_P(z)$ and $H_S(z)$ are arbitrary and unknown. So the goals of the solution is to pick the correction filter, $H(z)$, such that system output, $R(z)$, best approximates the original signal of interest (A) using only what can be learned from $P(z)$ and $S(z)$. In other words, pick $H(z) \approx H_P(z) H_S^{-1}(z)$.

The solution for identifying $H(z)$ described herein involves solving for a linear time invariant ("LTI") "black box" filter using variational inequalities (VI). This so-called black-box problem can be addressed in both deterministic and stochastic forms. In the deterministic form, both the primary and secondary signals are known a priori in their entirety and any stochastic processes that contributes to the input signal's construction are already complete, i.e. all random variables have been sampled. Thus, the solution found using the deterministic method is a single, optimal filter for the specific pair of signals. From the foregoing it will be understood that the deterministic method may not be ideal for real world applications involving the communication terminal because the pair of input signals are not known a priori in their entirety, and the acoustics of the environment are understood to be constantly changing over time. In the stochastic form of the solution, it is accepted that neither signal is known in its entirety at any point while solving for $H(z)$. Instead, multiple samples are drawn from the signals to create a series of approximate solutions. These approximate solutions will ultimately converge to the same answer as found by the deterministic method.

Because of the respective characteristics and preconditions associated with each of the deterministic and stochastic solutions, the deterministic method is most suitable for post-processing applications where one time-invariant solution is needed. The stochastic method is most suitable for real-time applications but still suffers from certain limitations when applied to practical signal processing applications. These limitations are described in further detail below, followed by a description and analysis of an optimal solution which is referred to herein as an adaptive stochastic method. An understanding of the optimal solution is best understood with reference to an understanding of the deterministic solution and a basic (non-adaptive) stochastic solution. Accordingly, the detailed description below includes a description of the deterministic solution followed by a (non-adaptive) stochastic solution to provide context for an optimal adaptive stochastic method.

Review of the Z-Transform

The analysis disclosed herein relies heavily of the Z-transform, which is the discrete-time equivalent to the Laplace transform. To review, if $x[k]=x_k$ is a discrete time signal, where $x_k \in \mathbb{R}$, then the Z-transform of x is $$X(z) = \mathcal{Z}\{x[k]\} = \Sigma_{k=-\infty}^{+\infty} x_k z^{-k} \tag{1}$$

The corresponding inverse transform is given by the contour integral $$x[k] = Z^{-1}\{X(z)\} = \frac{1}{2\pi j}\oint_C X(z) z^{k-1} dz \tag{2}$$

where C is a contour around the origin enclosing all of the poles (roots of the denominator) of X(z).

Note that the Z-transform is a Laurent series over z. To avoid potential distractions regarding infinite time-domain sequences, we define $\mathcal{S}_{M,N}$ to be the set Laurent series of z only containing non-zero coefficients between the M-th and N-th powers of z. This restriction causes no loss of utility in engineering applications.

$$\mathcal{S}_{M,N} = \{\Sigma_{k=M}^{N} c_k z^{-k} | N, M \in \mathbb{Z}, c_k \in \mathbb{R}\} \tag{3}$$

The advantage of the Z-transform is that is simplifies the bookkeeping of the essential operation of linear time-invariance systems, including convolution and correlation. To review, convolution in the time domain is multiplication in the Z-domain $$\mathcal{Z}\{x[k]*y[k]\} = X(z)Y(z) \tag{4}$$

and correlation is convolution with a time reversal $$Z\{x[-k]*y[k]\} = X\left(\frac{1}{z}\right)Y(z) \tag{5}$$

There are two operations required here that are not in common usage for the Z-transform: an inner-product and projection onto arbitrary $\mathcal{S}_{M,N}$ sets. We define as the inverse Z-transform of the correlation of two signal evaluated at zero.

$$\langle X(z), Y(z)\rangle = Z^{-1}\left\{X\left(\frac{1}{z}\right)Y(z)\right\}[0] = \frac{1}{2\pi j}\oint_C X\left(\frac{1}{z}\right)Y(z) z^{-1} dz \tag{6}$$

This definition is equivalent to the inner product of the two associated time series.

$$\langle (X(z), Y(z)\rangle = \langle x[k], y[k]\rangle = \Sigma_{k=-\infty}^{+\infty} x_k y_k \tag{7}$$

The projection operation is denoted $\Pi_{S_{M,N}}$ maps $S_{-\infty,+\infty}$ onto $S_{M,N}$ such that $$\Pi_{S_{M,N}}(\Sigma_{k=-\infty}^{\infty} c_k z^{-k}) = \Sigma_{k=M}^{N} c_k z^{-k} \tag{8}$$

which is simply the truncation of the coefficients outside the powers of z included in the set.

Choosing the Correction Filter H(z)

Various different methods and techniques can be applied to the problem of choosing the correction filter H(z). Alternatives include both a deterministic method and a stochastic method. A brief discussion of each is provided below, followed by a more detailed description of an adaptive stochastic method which overcomes limitations of both.

Deterministic Method

Recalling FIG. 2, let $P(z) \in \mathcal{S}_{M,N}$ be the z-transform of a discrete-time signal composed of signal and noise. Let $S(z) \in \mathcal{S}_{M,N}$ be the z-transform of the noise in P(z) transformed by an unknown linear time-invariant filter. Let H(z) be z-transform of an approximation of the unknown filter. Let R(z, H(z)) be the residual signal after correcting P(z) using H(z) and S(z).

$$R(z,H(z)) = P(z) - H(z)S(z) \tag{9}$$

Assuming the characteristics of the signal within P(z) are unknown, a good criterion for optimizing the choice of H(z) is to minimize the $L_2$ norm (sometimes referred to as the Euclidean norm) of R(z, H(z)); let J[H(z)] be that norm.

$$J[H(z)] = \|R(z, H(z))\|^2 \tag{10}$$

$$= \|P(z) - H(z)S(z)\|^2 \tag{11}$$

$$= \langle P(z) - H(z)S(z), P(z) - H(z)S(z)\rangle \tag{12}$$

By its construction, J is convex and has exactly one minimum. Using the calculus of variations, H(z) can be shown to be that minimum if $$J[H(z)] \leq J[H(z) + \epsilon\eta(z)] \ \forall \eta(z) \in \mathcal{S}_{M,N} \tag{13}$$

for any $\epsilon \in \mathbb{R}$ close to zero and $\eta(z)$ is any Laurent series of z with a finite number of non-zero coefficients. Following the derivation of the Euler-Lagrange equation, H(z) also minimizes J when the derivative of J with respect to E evaluated at zero is identically zero for all choices of $\eta(z)$.

$$\frac{d}{d\epsilon} J[H(z) + \epsilon\eta(z)]\Big|_{\epsilon=0} \equiv 0 \forall \ \eta(z) \in \mathcal{S}_{M,N} \tag{14}$$

$$\langle \eta(z)S(z), S(z)H(z) - P(z)\rangle \equiv 0 \forall \ \eta(z) \in \mathcal{S}_{M,N} \tag{15}$$

Recalling the definition of the inner product offered above in the discussion of the deterministic approach, we convert the inner product to the contour integral $$\langle \eta(z)S(z), S(z)H(z) - P(z)\rangle = \frac{1}{2\pi j}\oint_C \eta(z^{-1})F(z, H(z))z^{k-1}dz \tag{16}$$

where F(x, H(z)) is defined to be $$F(z, H(z)) = S(z^{-1})(H(z)S(z) - P(z)) \tag{17}$$

-continued $$= S(z^{-1})S(z)H(z) - S(z^{-1})P(z) \tag{18}$$

For the contour integral to be zero for all possible $\eta(z^{-1})$, F(z, H(z)) must also be identically zero. Therefore we can say F(z, H(z))≡0 if and only if H(z) minimizes J.

To build intuition about this result, we note the F(z, H(z)) is equivalent to the gradient of the cost function in a more traditional linear algebra approach. We further note that the product $S(z^{-1})S(z)$ is the auto-correlation function of S and $S(z^{-1})P(z)$ is the cross-correlation of S and P. Lastly we note that F(z, H(z)) is still a Laurent series of z, meaning that for F to be identically zero, all coefficients of F must be zero. In effect, F encodes a system of equations with one equation per power of z, all of which must be individually equal to zero.

$$\mathcal{Z}^{-1}\{F(z,H(z))\}[k] \equiv 0 \ \forall k \in \mathbb{Z} \tag{19}$$

If there are no constraints on what characteristics a solution needs to have, we can solve F(z, H(z))≡0 to find the global optimum. This may not be practical because H(z) may have an infinite number of non-zero coefficients even though P(z), $S(z) \in \mathcal{S}_{M,N}$. A more manageable approximation will be to constrain H(z) to $\mathcal{S}_{-R,+R}$, which would allow the solution to be implemented as an (2R+1)-tap finite impulse response (FIR) filter.

Depending on the application, additional constraints may also be required. We introduce $\mathcal{A}$ such that $\mathcal{A} \subseteq \mathcal{S}_{-R,+R}$ to be the admissible set containing all possible values of H(z) that satisfy all constraints of the application. A constrained minimization of J[H(z)] such that $H(z) \in \mathcal{A}$ can now be written as a variational inequality, provided $\mathcal{A}$ is both convex and compact.

$$\langle F(z,H(z)), Y(z) - H(z)\rangle \geq 0 \ \forall Y(z) \in \mathcal{A} \tag{20}$$

Solving this VI can be done using a fixed-point iteration scheme using equation 21, known as the natural equation, which requires a step-size, τ, and the projection operator, $\Pi_{\mathcal{A}}$, as defined above. Since F is a gradient of J for this application, the natural equation is equivalent to a steepest-descent method where the result of each iteration is projected back onto the solution set. Convergence on a solution is detected when $\|H_k(z) - H_{k-1}(z)\| < \epsilon$. The convergence of the natural equation is guaranteed if the defining function F is both strongly monotonic and Lipschitz continuous, and if τ is chosen to suit both properties of F.

$$H_{k+1}(Z) = \Pi_{\mathcal{A}}(H_k(z) - \tau F(z, H_k(z))) \tag{21}$$

There is a second category of iterative methods for solving variational inequalities known as the extra-gradient methods. These methods tend to be slower than other iterative solvers but have more reliable convergence properties, guaranteeing convergence when F is both monotone (but not strongly monotone) and Lipschitz continuous with constant L and step-size $$\tau \in \left(0, \frac{1}{L}\right).$$

the basic extra-gradient method is a two-step method defined as shown in equations 22 and 23.

$$\overline{H}_k(z) = \Pi_{\mathcal{A}}(H_k(z) - \tau_k F(z, H_k(z))) \tag{22}$$

$$H_{k+1}(z) = \Pi_{\mathcal{A}}(H_k(z) - \tau_k F(z, \overline{H}_k(z))) \tag{23}$$

The basic from of the extra-gradient method leaves the step-size constant across all iterations. A more robust method is known as Khobotov's method which estimates the local Lipschitz constant once per iteration and decreases the step-size if $\tau_k$ exceeds the reciprocal of that estimate. The Khobotov's method has been further refined by Marcotte's rule, which allows $\tau_k$ to increase each iteration subject to the upper limit described by Khobotov. The combination of Khobotov's method with Marcotte's rule ("the Khobotov-Marcotte algorithm") has shown to be useful for this application, and is shown in equation 24. The parameter $\alpha$ is the rate at which $\tau$ shrinks or expands and is typical around the value of one. The parameter $\beta$ scales the estimate of the reciprocal of the local Lipschitz constant such that $\beta \in (0,1)$. Finally, the parameter $\hat{\tau}$ is the minimum step-size, which should be significantly less than one but greater than zero.

$$\tau_k = \max\left\{\hat{\tau}, \min\left\{\alpha\tau_{k-1}, \beta\frac{\|\overline{H}_{k-1}(z) - H_{k-1}(z)\|}{\|F(z, \overline{H}_{k-1}(z)) - F(z, H_{k-1}(z))\|}\right\}\right\} \tag{24}$$

The Stochastic Method

Figure 3:
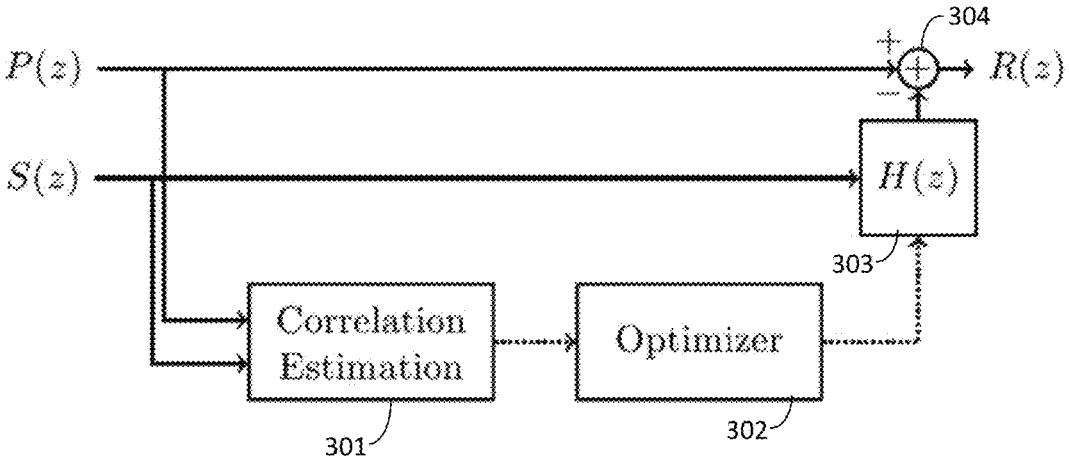
FIG. 3 is a flow diagram that is useful for understanding a stochastic method for reducing noise in a communication terminal.

For purposes of understanding the stochastic method it is useful to refer to FIG. 3. The flow diagram in FIG. 3 assumes as inputs the two signals P(z) and S(z) provided as outputs from the microphone systems in FIG. 2. In the stochastic method, H(z) is found by minimizing J[H(z)] using many successive short-term approximations of both the secondary signal's autocorrelation, $S(z^{-1})S(z)$, and the primary-secondary cross-correlation, $S(z^{-1})P(z)$. Drawing on stochastic optimization theory, it can be shown that with the correct choice of step-size, the sequence of intermediate results generated will converge to the results of the deterministic method described above. This quality makes the stochastic method valuable in engineering applications because it can produce useful approximate solutions without needing complete a priori knowledge of the entire signals and can therefore run in real-time.

As may be understood from FIG. 3, the stochastic method is basically is a two-step process involving (1) correlation estimation at 301 and (2) optimization at 302.

Correlation Estimation

The first step 301 of the stochastic method is to generate a sequence of estimates of both the secondary signal's autocorrelation, $S(z^{-1})S(z)$, and the secondary-to-primary cross-correlation, $S(z^{-1})P(z)$. To simplify the notation, the true autocorrelation of S and it's noisy estimate will denoted a U(z) and U(z, ω), respectively, where co is the (possibly infinite) set of random variables at play within the approximation of U. Similarly, the cross-correlation of S to P will be denoted as V(z) and V(z, ω).

$$U(z)=S(z^{-1})S(z) \tag{25}$$

$$V(z)=P(z^{-1})S(z) \tag{26}$$

The approximations of U and V may be calculated a variety of ways including a infinite impulse response (IIR) averaging methods and sliding window averaging methods. For the purposes of analysis, U and V are modeled as their true counterparts corrupted by additive random noise components. Let $\phi_1(z, \omega)$ and $\phi_2(z, \omega)$ be the random components of these respective approximations.

$$U(z,\omega)=U(z)+\phi_1(z,\omega) \tag{27}$$

$$V(z,\omega)=V(z)+\phi_2(z,\omega) \tag{28}$$

The estimates U(z, ω) and V(z, ω) will ultimately be used to calculate F while minimizing J[H(z)]. Since the solution filter H(z) is constrained to $\mathcal{S}_{-R,+R}$, the estimates of U(z, ω) and V(z, ω) only need to include terms necessary to approximate F in $\mathcal{S}_{-R,+R}$ as well. This is means $U(z, \omega) \in \mathcal{S}_{-2R,+2R}$ and $V(z, \omega) \in \mathcal{S}_{-R,+R}$ would be sufficient support.

Given this limitation on the reach of U(z, ω) and V(z, ω), U and V can be estimated directly in real time using the recent history of the time-domain primary and secondary signals p[t] and s[t]. Conveniently, the auto-correlation function U must have even symmetry so only half the function need to be observed.

The most trivial estimation method is to multiply the time-domain signals p[t] and s[t] with time-shifted versions of themselves and average over blocks of N samples. The resulting functions, $v_N[n, k]$ and $u_N[n, k]$ are indexed by their starting position in the time, n, and by relative time-shift of the component signals, k. It should be noted that N=1 produces a valid, if noisy, estimate.

$$u[n, k; N] = \frac{1}{N}\sum_{\substack{i=n \\ n+(N-1)}}^{n+(N-1)} s[i]s[i-k]n \in \mathbb{Z} \text{ and } k \in \{0, \ldots 2R\} \tag{29}$$

$$v[n, k; N] = \frac{1}{N}\sum_{i=n}^{n+(N-1)} p[i]s[i-k]n \in \mathbb{Z} \text{ and } k \in \{-R, \ldots + R\} \tag{30}$$

These time-domain estimates of the correlations functions can be related back to corresponding z-domain noisy correlation functions by treating each starting position of the block averages as separate samples of the set of random variables in ω. Note that the formula for U is exploiting the even symmetry of the function.

$$U(z, \omega_n; N) = \sum_{k=0}^{2R} u_N[n, k](z^k + z^{-k}) \tag{31}$$

$$V(z, \omega_n; N) = \sum_{k=-R}^{R} v_n[n, k]z^{-k} \tag{32}$$

Optimization

The second step 302 of the stochastic method is to iteratively estimate $H(z) \in \mathcal{A}$ to minimize J[H(z)] using many successive samples of the correlation functions U(z, ω) and V(z, ω). Similarly to the deterministic method described above, the true solution H(z) will reached by a stochastic version of the natural equation, shown in equation 33, where the step-size $\tau$ is replaced by a sequence of step-sizes $\tau_k$ that must converge towards zero at the right rate.

$$H_{k+1}(Z)=\Pi_{\mathcal{A}}(H_k(z)-\tau_k F(z,\omega,H_k(z))) \tag{33}$$

In equation 33, the short-term approximation of F is denoted F(z, ω, H(z)) and is defined similarly as a function of the approximations of U and V. Since F is linear with respect to U and V, F(z, H(z)) is also equal to its deterministic counterpart plus additive random noise.

$$F(z, \omega, H(z)) = U(z, \omega)H(z) - V(z, \omega) \tag{34}$$

$$= F(z, H(z)) + (\phi_1(z, \omega)H(z) - \phi_2(z, \omega)) \tag{35}$$

The challenge in using the stochastic natural equation is in choosing the step-size to manage both the noise in the approximations of the correlation functions and the convergence criteria of the solution. The requirement that $\tau_k$ to go to zero as k goes to infinity is not suitable for typically real-time signal processing applications where conditions cannot be assumed to persist indefinitely. In a practical signal processing application, conditions typical evolve over time such that current optimization problem may be replaced by another related problem. To address this, step-sizes are usually bounded away from zero by some small positive number so that the algorithm can always adapt. This means convergence to the deterministic solution is never achieved, but the iterative approximations remaining close enough to truth to be useful.

In the stochastic solution, the solution of $H(z)$ once determined is applied at 303. The resulting operation on $S(z)$ at 303 will produce the necessary correction signal which is then subtracted from $P(z)$ at 304. Subtracting the correction signal from $P(z)$ from leaves remainder $R(z)$ which comprises the signal of interest.

Adaptive Stochastic Method

Figure 4:
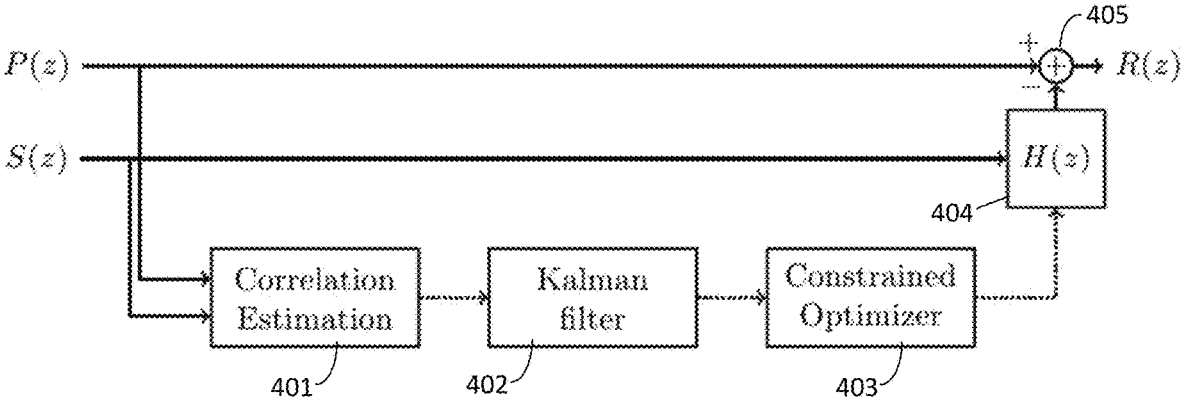
FIG. 4 is a flow diagram that is useful for understanding an adaptive stochastic method for reducing environmental noise in a communication terminal.

As discussed in the previous section, the challenge to the stochastic method for real-time signal processing applications is choosing the solver's step-size to balance two key attributes, the rate of convergence to the solution and the noise rejection of the algorithm, which often run contrary to each other. The method offered here attempts to separate noise rejection from the constrained optimizer by adding a Kalman filter of the correlation functions, and thus allowing the step-size to be chosen for the best rate of convergence. The resulting algorithm shown in FIG. 4 has three components or steps which include: estimating the auto and cross-correlations of the input signals in a correlation estimation operation at 401, Kalman filtering the correlations to reduce noise in a filtering operation at 402, and then solving the constrained stochastic optimization problem at 403 using fixed-point iteration. The resulting transfer function $H(z)$ is then applied at 404 to $S(z)$ to obtain a correction signal. The correction signal is then subtracted from $P(z)$ at 405 to obtain $R(z)$ comprising the signal of interest.

This approach is reasonable because the defining function of variational inequality, F, is linear with respect to the noisy estimates of the correlation functions, $U(z, \omega)$ and $V(z, \omega)$, as shown in equation 34. This means that the expectation of F solved using noisy estimates of the correlation functions is the same as F solved with the expectation of the same noisy correlation estimates; in other words, the expectation can be taken on the inputs or the outputs of F with changing the answer.

$$E[F(z, \omega, H(z))] = E[U(z, \omega)H(z) - V(z, \omega)] \tag{36}$$

$$= E[U(z, \omega)]H(z) - E[V(z, \omega)] \tag{37}$$

Correlation Estimation

The first step of the adaptive-stochastic method is to calculate estimates of the correlation functions, $V(z, \omega_n)$ and $U_N(Z, \omega_n)$. These estimates are calculated in the same as the manner as for the stochastic method above. Care should be taken in choosing the averaging block-size parameter N because it has a direct impact on the performance of Kalman filter in next step. Larger values of N will perform better than small values.

The Kalman filters are provably optimal for linear systems with additive Gaussian noise and retain good performance when the noise is only approximately Gaussian. For the best overall performance, it is therefore necessary to have the noise about U and V to be approximately Gaussian as possible. When N is small, there is higher risk that the noise about U and V may not be sufficiently Gaussian because the noise about U and V becomes increasingly dependent on the characteristics of the underlying signals S and P as N approaches one. Consider input signals S and P each with independent, additive Gaussian noise. For such inputs, the noise around U and V for N=1 will both be the products of two Gaussian random variables. These Gaussian-product distributions have high kurtosis and thus are poor approximations of Gaussian distributions. Accordingly, the performance of the Kalman filter for U and V for N=1 will suffer. For other noise distributions on S and P, the performance loss may be arbitrarily bad.

The solution to the under-performance of the Kalman filter is to increase N. The central limit theorem states that as N becomes large, the error in $U_N$ and $V_N$ will become Gaussian. Accordingly, there will be a large enough N to support the desired performance of the overall system. In practice, larger values of N have larger computation costs, so the best choice of N will always be a trade-off dependent on the characteristics of S and P as well as the available computation budget. It is therefore recommended that the noise characteristics of S and P be understood prior to choosing N whenever possible.

Kalman Filter

The Kalman filters in the second step of the adaptive-stochastic method further refine the $V(z, \omega_n; N)$ and $U(z, \omega_n; N)$ functions calculated in the first step in better estimates of the true $V(z)$ and $U(z)$ functions. These refined estimates will be denoted as $\hat{U}$ and $\hat{V}$. The formulation of these Kalman filters follows the standard formulation described in modern control theory with one departure: the observers treats the vector representations of $V(z, \omega_n; N)$ and $U(z, \omega_n; N)$ as two atomic state variables rather than two vectors of 2R+1 independent scalars. This can be thought of as the observers working on function-valued state variables instead of scalar-valued state variables. The end result of this alteration is a significant decrease in computation cost with no loss of optimality for this particular application.

Filter Algorithm

The Kalman filter is a non-linear, two-phase iterative algorithm for estimating the current state of a system using a dynamical model describing the evolution of the system's state over time, and an observation model relating system's state to a set of noisy measurements. The classic Kalman filter assumes both models are linear and all noises are Gaussian. Both these assumption are true for this application.

For each iteration, the first phase of the Kalman filter is to predict the current state estimate of the system using the prior state estimate, and to predict the variance of the error in the current state estimate from the variance of the error in the prior state estimate. Equation 38 shows the trivial state prediction: the prediction of the current state, denoted as $\hat{U}_{k|k-1}$ and $\hat{V}_{k|k-1}$, is the same as the prior state. This trivial prediction is often sufficient for applications where $H(z)$ is not expected to change quickly. More complex prediction steps can also be used if required by a particular application.

Equation 39 shows the predictive update of the variance of the error around the state vector, denoted as $\hat{\sigma}$. Unlike equation 38, this equation is the same for all applications. Here the predicted variance $\hat{\sigma}_{k|k-1}$ is shown to be the variance of the prior iteration, $\hat{\sigma}_{k-1|k-1}$, plus the process noise q. In a typical Kalman implementation, both $\hat{\sigma}$ and q are covariance matrices, but this algorithm exploits a special case allowing both to be scalars; discussion of this special case will follow.

$$\hat{U}_{k|k-1}=\hat{U}_{k-1|k-1} \tag{38}$$

$$\hat{\sigma}_{k|k-1}=\hat{\sigma}_{k-1|k-1}+q \tag{39}$$

The second phase of the Kalman filter is to update the current state estimate using measured data. For this application, this second phase it further broken down into two steps: first, LTI filtering the raw correlation functions U(z, ω; N) and V(z, ω; N) and estimating the variance of their errors, and second, calculating updating the current state estimate and it's variance. Both steps are implemented as single-pole low-pass IIR filter, but the latter update of the state estimate uses a adaptive time constant chosen by the Kalman equations.

Equation 40 shows the update of the estimated mean of the raw input U(z, ω; N); V (z, ω; N) is processed similarly. The mean is denoted as $\overline{U}$. The parameter α is chosen so that the time constant of the averaging is relatively short. The goal of this filter is mainly to support the estimation of the variance of the input data; the bulk of the filtering occurs in the next step.

Equation 41 shows the update of the estimated variance of the raw input U(z, ω; N); again, V(z, ω; N) is processed similarly. The variance is denoted as $\overline{\sigma}$ and is calculated as the low-pass filtered squared norm of the difference of the current measurement of the expected measurement $\overline{U}$. Again, these estimates of the variance would typically be covariance matrices, but this algorithm exploits a special case allow the variances to be scalars. These equations would also usually explicitly include the measurement model, which predicts the expected measurements as function of the current state. For this application, the measurements and the state estimates are both the correlation functions U and V, so the measurement model is the identity matrix and can be omitted.

$$\overline{U}_k=\overline{U}_{k-1}+\alpha(U_k-\overline{U}_{k-1}) \tag{40}$$

$$\overline{\sigma}_k^2=\overline{\sigma}_{k-1}^2+\alpha\|U_k-\overline{U}_{k-1}\|^2 \tag{41}$$

Using the variances of the predicted state and the input measurement, the Kalman gain can be calculated as shown in equation 42. Here again, this equation has been simplified from matrices to scalars. This substitution is a significant cost savings over the standard algorithm because the denomination of the division would require the factoring or inversion of a (2R+1)×(2R+1) matrix for each iteration of the algorithm.

$$K=\frac{\hat{\sigma}_{k|k-1}^2}{\hat{\sigma}_{k|k-1}^2+\overline{\sigma}_k^2} \tag{42}$$

Finally, equation 43 shows the current state estimate update as the weighted sum of the predicted current state and the measured state, where the weighting of the sum is set by the Kalman gain calculated in equation 42. Equation 44 shows the corresponding update to the variance of the error around the state estimate.

$$\hat{U}_{k|k}=\hat{U}_{k|k-1}+K(\overline{U}_k-\hat{U}_{k|k-1}) \tag{43}$$

$$\hat{\sigma}_{k|k}^2=(1-K)\hat{\sigma}_{k|k-1}^2 \tag{44}$$

Algorithm Analysis

A noteworthy aspect of the algorithm described in the foregoing section is that the variances are represented as scalars instead of matrices. The variance of a vector-valued random variable is normally described as a matrix which contains the variance of each vector component individually and the covariance of all pairwise combinations of the vector components. In contrast, the variance of a complex-valued random variable is described as a single real-value scalar despite the complex value's similarity to a vector with dimension 2. This is because the complex value is considered to be atomic—the real and imaginary components of the values cannot be considered individually as is done with a vector. In a solution described herein, the optimization of the Kalman filter is done by treating the vector approximations of the correlation functions in a manner that is similar to the complex value. The correlation functions are thus treated as atomic values (in this case a function) and thus the variance is a single real-only scalar. This method is instructed by the calculus of variations.

Ultimately, the foregoing optimization cuts out the need for costly matrix inversion/factoring steps required by the canonical Kalman filter, and for this specific application, this optimization comes with no penalty to performance. This substitution is a significant saving in computation cost without loss of optimality for special case: if the measurement variance and the process variance differ only by a scalar multiplier, then the Kalman gain will effectively become a scalar value. Consider a Kalman filter consisting of trivial prediction and measurement models, with state variance $P_i$, constant process variance Q, and constant measurement variance R. The canonical Kalman gain for this system is shown matrix notation in equation 45. Note that $P_i$+Q is the state variance after prediction, so this equation 46 cascades the prediction and update steps into one.

$$K_i=(P_i+Q_i)(P_i+Q_i+R_i)^{-1} \tag{45}$$

$$P_{i+1}=(I-K_i)(P_i+Q_i) \tag{46}$$

The Kalman algorithm calls for running equations 45 and 46 endlessly with the guarantee that limiting value of the state variance $P_\infty$ will be the global achievable minimum. The value of $P_\infty$ is defined implicitly in equation 47 by substituting equation 45 into equation 46 and setting $P_i=P_{i+1}=P_\infty$. For any given pair of constant process variance Q and constant measurement variance R, there will be a unique solution for $P_\infty$.

$$P_\infty=(I-(P_\infty+Q)(P_\infty+Q+R)^{-1})(P_\infty+Q) \tag{47}$$

The premise for this numerical shortcut is that the process and measure variances are scaled version of a common matrix, so we assume Q=qS, and R=rS where S is common covariance matrix related to the raw data and q and r are positive scalars. If $P_\infty$=pS where p is also a positive scalar, then the implicit definition of $P_\infty$ can be reduced to equation 48.

$$(p^2+pq-qr)S=0 \tag{48}$$

Equation 48 is clearly satisfied if the quadratic polynomial of p of scalar equals to zero. The determinant of this polynomial is $q^2+4qr$, which is the sum of products of positive number and is therefore positive. Accordingly, p has two real roots, only one of which can be valid given the uniqueness of $P_\infty$. Further examination of the determinate shows $\sqrt{q^2+4qr}>q$, meaning p will have one positive and one negative root. The negative root is outside the domain of valid scalars because pS would not have the proper construction to be a covariance matrix if $p<0$. We therefore conclude the positive root of p provides the one and only solution to $P_\infty=pS$.

Returning to equation 45 with that the knowledge that $P_\infty=pS$ given $Q=qS$ and $R=rS$, we find the limiting value of the Kalman gain $K_\infty=kI$, where is $k\in[0,1]$ and I is the identity matrix. Essentially, the Kalman gain matrix has been reduced to a gain scalar, and iterative scalar Kalman algorithm converges to the same gain as the iterative matrix algorithm. Applying these scalar substitutions to equations 46 and 45 reduced them to the prediction and update equations seem in the discussion above concerning the filter algorithm, thereby resulting in significantly reduced computation cost.

For all of the above to be applicable, the requirement that the process and measure variances are scaled version of a common matrix must be true. This is true for this application because the Kalman filter is refining the short-time estimates $\overline{U}$ and $\overline{V}$ into long-time estimates of the same functions, $\hat{U}$ and $\hat{V}$, using the same basic averaging technique. When averaging sets of random samples, it is expected that the variance from one set to another to decrease in magnitude as the number of samples increases but for the underlying correlations to remain. The same is true here: the process noise of the Kalman filters for $\hat{U}$ and $\hat{V}$ is expected to be similar to the measurement noise for $\overline{U}$ and $\overline{V}$ because they are both averages of raw samples of U and V. Conveniently, the common variance matrices for U and V never need to be determined to exploit this special case as the common matrices cancels themselves in the Kalman gain equation. Only the scalar multipliers have practical meaning, so this modified algorithm will work for any choice of $U(z, \omega)$ and $V(z, \omega)$.

Constrained Optimization

The last step of the adaptive-stochastic method is to determine the best filter H(z) given the estimates of $\hat{U}$ and $\hat{V}$ discovered by the Kalman filters, subject to the constraints which define the admissible set $\mathcal{A}$. The optimizing method used here is the same Khobotov-Marcotte algorithm which was described above. The choice of the admissible set $\mathcal{A}$ will be application dependent, but a general recommendation is to place L2 of L-infinity bounds on the possible of values of H(z) to prevent the system from chasing unreasonable solutions.

Figure 5:
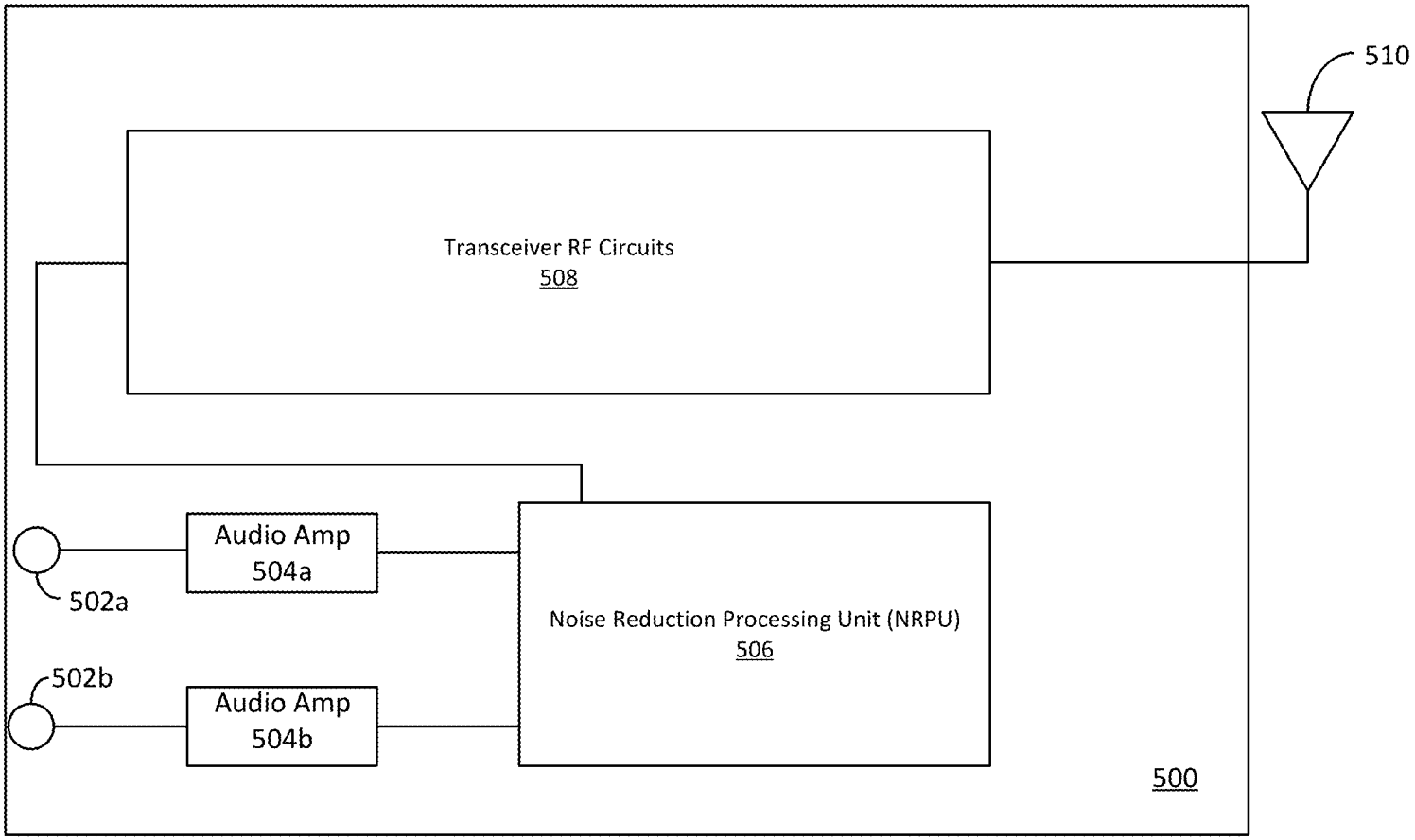
FIG. 5 is a block diagram that is useful for understanding an architecture of a communication terminal incorporating a noise reduction system.

Shown in FIG. 5 is a block diagram that is useful for understanding a communication terminal 500 in which the adaptive stochastic solution for reducing noise can be implemented as described herein. The communication terminal in this example is a wireless communication terminal but it should be understood that the solution is also applicable to other types of communication terminals. The communication terminal 500 includes a first and second microphones 502*a*, 502*b*, and audio amplifier circuits 504*a*, 504*b*. In some scenarios, the first microphone 502*a* and associated audio amplifier circuit 504*a* comprise a first microphone system. Similarly, the second microphone 502*b* and associated audio amplifier circuit 504*b* can comprise a second microphone system. The first and second microphone systems communicate received signals from detected sounds to a noise reduction processing unit (NRPU) 506. The NRPU processes audio signals from the first and second microphone systems to reduce far field noise using an adaptive stochastic method described herein. The reduced noise signal is then communicated to the transceiver RF circuits 508 and antenna 510.

The NRPU described herein can comprise one or more components such as a computer processor, an application specific circuit, a programmable logic device, a digital signal processor, or other circuit programmed to perform the functions described herein. The system can be realized in one computer system or several interconnected computer systems. Any kind of computer system or other apparatus adapted for carrying out the methods described herein is suited.

Figure 6:
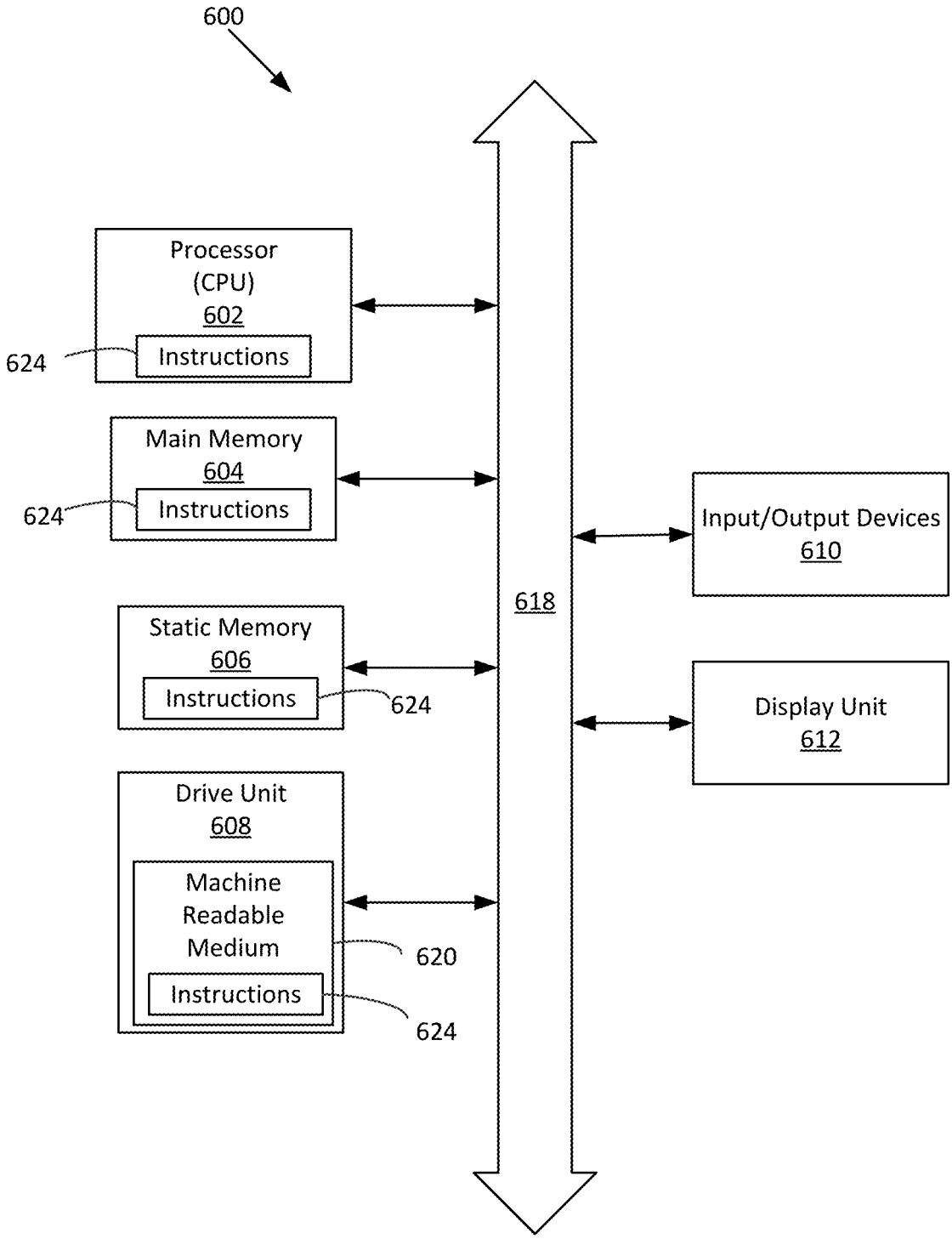
FIG. 6 is a block diagram of an exemplary computer processing system that can perform processing operations as described herein for purposes of implementing an adaptive stochastic noise reduction method.

Referring now to FIG. 6, there is shown an example of a hardware block diagram comprising an exemplary computer system 600 which can be used to implement the NRPU. The computer system can include a set of instructions which are used to cause the computer system to perform any one or more of the methodologies discussed herein. While only a computer system is illustrated it should be understood that in other scenarios the system can be taken to involve any collection of machines that individually or jointly execute one or more sets of instructions as described herein.

The computer system 600 is comprised of a processor 602 (e.g. a central processing unit or CPU), a main memory 604, a static memory 606, a drive unit 608 for mass data storage and comprised of machine readable media 620, input/output devices 610, a display unit 612 (e.g. a liquid crystal display (LCD) or a solid state display. Communications among these various components can be facilitated by means of a data bus 618. One or more sets of instructions 624 can be stored completely or partially in one or more of the main memory 604, static memory 606, and drive unit 608. The instructions can also reside within the processor 602 during execution thereof by the computer system. The input/output devices 610 can include a keyboard, a mouse, a multi-touch surface (e.g. a touchscreen) and so on.

The drive unit 608 can comprise a machine readable medium 620 on which is stored one or more sets of instructions 624 (e.g. software) which are used to facilitate one or more of the methodologies and functions described herein. The term "machine-readable medium" shall be understood to include any tangible medium that is capable of storing instructions or data structures which facilitate any one or more of the methodologies of the present disclosure. Exemplary machine-readable media can include magnetic media, solid-state memories, optical-media and so on. More particularly, tangible media as described herein can include; magnetic disks; magneto-optical disks; CD-ROM disks and DVD-ROM disks, semiconductor memory devices, electrically erasable programmable read-only memory (EEPROM)) and flash memory devices. A tangible medium as described herein is one that is non-transitory insofar as it does not involve a propagating signal.

Computer system 600 should be understood to be one possible example of a computer system which can be used in connection with the various implementations disclosed herein. However, the systems and methods disclosed herein are not limited in this regard and any other suitable computer system architecture can also be used without limitation. Dedicated hardware implementations including, but not limited to, application-specific integrated circuits, programmable logic arrays, and other hardware devices can likewise be constructed to implement the methods described herein. Applications that can include the apparatus and systems broadly include a variety of electronic and computer systems. In some scenarios, certain functions can be implemented in two or more specific interconnected hardware modules or devices with related control and data signals communicated between and through the modules, or as portions of an application-specific integrated circuit. Thus, the exemplary system is applicable to software, firmware, and hardware implementations.

Further, it should be understood that embodiments can take the form of a computer program product on a tangible computer-usable storage medium (for example, a hard disk or a CD-ROM). The computer-usable storage medium can have computer-usable program code embodied in the medium. The term computer program product, as used herein, refers to a device comprised of all the features enabling the implementation of the methods described herein. Computer program, software application, computer software routine, and/or other variants of these terms, in the present context, mean any expression, in any language, code, or notation, of a set of instructions intended to cause a system having an information processing capability to perform a particular function either directly or after either or both of the following: a) conversion to another language, code, or notation; or b) reproduction in a different material form.

Furthermore, the described features, advantages and characteristics disclosed herein may be combined in any suitable manner. One skilled in the relevant art will recognize, in light of the description herein, that the disclosed systems and/or methods can be practiced without one or more of the specific features. In other instances, additional features and advantages may be recognized in certain scenarios that may not be present in all instances.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

Although the systems and methods have been illustrated and described with respect to one or more implementations, equivalent alterations and modifications will occur to others skilled in the art upon the reading and understanding of this specification and the annexed drawings. In addition, while a particular feature may have been disclosed with respect to only one of several implementations, such feature may be combined with one or more other features of the other implementations as may be desired and advantageous for any given or particular application. Thus, the breadth and scope of the disclosure herein should not be limited by any of the above descriptions. Rather, the scope of the invention should be defined in accordance with the following claims and their equivalents.

We claim:

1. A method for noise reduction, comprising:

receiving a primary signal at a first microphone system of a communication device and a secondary signal at a second microphone system of the communication device, the first and the second microphone systems disposed at first and second locations on the communication device which are separated by a distance;

dynamically identifying an optimal transfer function of a correction filter which can be applied to the secondary signal processed by the second microphone system to obtain a correction signal;

subtracting the correction signal from the primary signal to obtain a remainder signal which approximates a signal of interest contained within the primary signal;

wherein the optimal transfer function is dynamically determined by (a) generating a sequence of estimates comprising both an autocorrelation of the secondary signal, and a cross-correlation of the secondary signal to primary signal, and (b) applying a noise filter to each estimate in the sequence of estimates to obtain a sequence of filtered estimates with reduced noise;

(c) iteratively estimating the optimal transfer function using the sequence of filtered estimates.

2. The method according to claim 1, wherein the filter is a Kalman filter.

3. The method according to claim 2, wherein a computation cost of the Kalman filter process is reduced by defining both the vector representations of the correlation function and the autocorrelation function as atomic state variables.

4. The method according to claim 2, wherein a computation cost of the Kalman filter is reduced by defining in the Kalman filter a variance associated with both an error around a current state estimate and a process noise to be scalar values.

5. The method according to claim 2, wherein the Kalman gain is a scalar value.

6. The method according to claim 2, wherein the optimal correction filter is determined using a Khobotov-Marcotte algorithm.

7. The method according to claim 1, wherein far field sound originating in a far field environment relative to the first and second microphone systems produces a first difference in sound signal amplitude at the first and second microphone systems.

8. The method according to claim 7, wherein the sound signal amplitude of the far field sound is received at approximately equal amplitude levels in the first and second microphone systems.

9. The method according to claim 7, further comprising selecting the first and second locations so that near field sound originating in a near field environment relative to the first microphone produces a second difference in sound signal amplitude at the first and second microphone systems.

10. The method according to claim 9, wherein the second difference is greater than the first difference.

11. The method according to claim 9, wherein the first and second locations are selected so that the near field sound is received at a substantially higher sound signal amplitude by the first microphone system as compared to the second microphone system.

12. A communication terminal, comprising:

a first microphone system and a second microphone system;

a noise reduction processing unit (NRPU) configured to receive a primary signal from the first microphone system and a secondary signal from the second microphone system, dynamically identify an optimal transfer function of a correction filter which can be applied to the secondary signal provided by the second microphone system to obtain a correction signal, and subtract the correction signal from the primary signal to obtain a remainder signal which approximates a signal of interest contained within the primary signal;

wherein the optimal transfer function is dynamically determined by (d) generating a sequence of estimates comprising both an autocorrelation of the secondary signal, and a cross-correlation of the secondary signal to primary signal, and (e) applying a noise filter to each estimate in the sequence of estimates to obtain a sequence of filtered estimates with reduced noise;

(f) iteratively estimating the optimal transfer function using the sequence of filtered estimates.

13. The communication terminal according to claim 12, wherein the filter is a Kalman filter.

14. The communication terminal according to claim 13, wherein the NRPU is configured to reduce a computation cost of the Kalman filter process by defining both the vector representations of the correlation function and the autocorrelation function as atomic state variables.

15. The communication terminal according to claim 13, wherein the NRPU is configured to reduce a computation cost of the Kalman filter by defining in the Kalman filter a variance associated with both an error around a current state estimate and a process noise to be scalar values.

16. The communication terminal according to claim 13, wherein the Kalman gain is a scalar value.

17. The communication terminal according to claim 13, wherein the NRPU is configured to determine the optimal correction filter by using a Khobotov-Marcotte algorithm.

18. The communication terminal according to claim 11, wherein the first microphone system includes a first microphone and the second microphone system includes a second microphone, the first and second microphones respectively disposed at first and second locations on the communication terminal and separated by a distance.

19. The communication terminal according to claim 18, wherein far field sound originating in a far field environment relative to the first and second microphones produces a first difference in sound signal amplitude at the first and second microphone systems.

20. The communication terminal according to claim 18, wherein first and second microphones are positioned so that the sound signal amplitude of the far field sound is received at approximately equal amplitude levels in the first and second microphone systems.

21. The communication terminal according to claim 18, wherein the first and second microphones are positioned to cause near field sound originating in a near field environment relative to the first microphone to produce a second difference in sound signal amplitude at the first and second microphone systems.

22. The communication terminal according to claim 20, wherein the second difference is greater than the first difference.

23. The communication terminal according to claim 20, wherein the positions of the first and second locations are selected so that the near field sound is received at a substantially higher sound signal amplitude by the first microphone as compared to the second microphone.

* * * * *